US009261247B2

(12) United States Patent
Moon et al.

(10) Patent No.: US 9,261,247 B2
(45) Date of Patent: Feb. 16, 2016

(54) LED LAMP WITH A FAN AND MANUFACTURING METHOD THEREOF

(71) Applicant: DONG GUAN NATIONAL STATE LIGHTING CO., LTD, Dongguan, Guangdong (CN)

(72) Inventors: Daisung Moon, Hong Kong (HK); Sangpil Moon, Hong Kong (HK)

(73) Assignee: DONG GUAN NATIONAL STATE LIGHTING CO., LTD, Dongguan (CN)

( * ) Notice: Subject to any disclaimer, the term of this patent is extended or adjusted under 35 U.S.C. 154(b) by 143 days.

(21) Appl. No.: 14/123,089

(22) PCT Filed: Oct. 14, 2013

(86) PCT No.: PCT/CN2013/085156
§ 371 (c)(1),
(2) Date: Nov. 27, 2013

(87) PCT Pub. No.: WO2015/054809
PCT Pub. Date: Apr. 23, 2015

(65) Prior Publication Data

US 2015/0103537 A1 Apr. 16, 2015

(51) Int. Cl.

| | |
|---|---|
| ***F21K 99/00*** | (2010.01) |
| ***F21V 29/506*** | (2015.01) |
| ***F21V 29/67*** | (2015.01) |
| ***F21V 29/83*** | (2015.01) |
| *F21V 19/00* | (2006.01) |
| *F21Y 101/02* | (2006.01) |
| *F21V 3/02* | (2006.01) |
| *F21Y 111/00* | (2006.01) |
| *F21V 29/77* | (2015.01) |

(52) U.S. Cl.
CPC ..... *F21K 9/90* (2013.01); *F21K 9/1355* (2013.01); *F21V 29/506* (2015.01); *F21V 29/67* (2015.01); *F21V 29/83* (2015.01); *F21V 3/02* (2013.01); *F21V 19/0055* (2013.01); *F21V 29/77* (2015.01); *F21Y 2101/02* (2013.01); *F21Y 2111/001* (2013.01)

(58) Field of Classification Search
CPC ..... F21V 29/50; F21V 29/506; F21V 29/67; F21V 29/83; F21V 29/77; F21V 3/02; F21V 19/0055; F21K 9/90; F21K 9/1355; F21Y 2101/02; F21Y 2111/001
See application file for complete search history.

(56) References Cited

U.S. PATENT DOCUMENTS

| | | | | |
|---|---|---|---|---|
| 2005/0111234 | A1* | 5/2005 | Martin et al. | 362/555 |
| 2012/0188780 | A1* | 7/2012 | Wilk | 362/509 |

FOREIGN PATENT DOCUMENTS

| | | | |
|---|---|---|---|
| CN | 101509653 A | | 8/2009 |
| CN | 101825231 A | * | 9/2010 |

* cited by examiner

*Primary Examiner* — Mary Ellen Bowman

(57) ABSTRACT

The present invention relates to a LED lamp with a fan and manufacturing method thereof. A lamp body of the LED lamp has an upper lamp body and a lower lamp body connected together; an external wall of a facet of a prism of the upper lamp body is covered with a LED aluminum substrate connected to a LED PCB, a capacitor is soldered at the center of the bottom of the PCB, a LED driving circuit and a fan both are received in a cavity of a lamp holder; air flows into the LED lamp from an air inlet of the lower lamp body and a window of the lamp holder, then passes through an air outlet, a penetrating hole and an air flow channel, and finally an air outlet flue opened in a lamp cover and matching the penetrating hole dissipates heat away from the LED lamp.

4 Claims, 3 Drawing Sheets

LED LAMP WITH A FAN AND MANUFACTURING METHOD THEREOF

FIELD OF THE INVENTION

The present invention relates to a LED lamp, more particularly to a LED lamp with a fan and manufacturing method thereof.

BACKGROUND OF THE INVENTION

Chinese patent application No. 200910105878.0 has disclosed a high-power LED lamp structure with a fan, the fan can effectively cool a radiator and a metal substrate to make a LED illuminant maintain low operating temperature, which helps the LED lamp work normally. In addition, an external end of the LED illuminant is provided with an optical component which is used for light diffusion, light reflections and/or light gathering, in this way, the high-power LED lamp can meet the requirements of various occasions. The high-power LED lamp structure with a fan comprises a high-power LED illuminant, a metal substrate for fixing the high-power LED illuminant and a radiator connected to the metal substrate. The metal substrate is arranged in front of the radiator, and the radiator is also provided with a fan; the radiator is a tubular body with a hollow cavity, and the fan is fixed at the center of an end of the radiator. An external ring of the radiator is provided with a plurality of fins, an external end of the LED illuminant is provided with an optical component which is used for the optical treatment of LED light, furthermore, an end of the radiator is circularly provided with a lamp cap having a LED driving circuit therein. However, the fan only cools the fins of the LED lamp, therefore, this kind of LED lamp will have a low heat dissipation efficiency if there is no air flow channel in inner cavity of the LED lamp.

Besides, a low-power LED lamp can maintain a proper temperature due to its cooling fin. However, when larger luminous flux is required, dissipation of heat generated by the LED lamp then becomes a problem.

SUMMARY OF THE INVENTION

The present invention aims to provide a LED lamp with a fan, the LED lamp has an air flow channel therein and dissipates heat by a lamp cover thereof, thereby the LED lamp of the present invention has a high heat dissipation efficiency. The LED lamp of the present invention also has a guiding passageway that facilitates assembling a wire. In addition, a lamp body is not exposed to users and is received in the lamp cover, in this way, users will not contact metal of the LED lamp directly and the use of this LED lamp is thus very safe. The present invention also aims to provide a method for manufacturing a LED lamp with a fan.

The present invention aims to provide a LED lamp with a fan comprising a lamp body sleeving a lamp holder, and a lamp cover connected to the lamp body, characterized in that, the lamp body consists of an upper lamp body and a lower lamp body connected by a fixing element; the upper lamp body is a prism, an external wall of a facet of the prism is covered with a LED aluminum substrate, and all the LED aluminum substrates are connected to a LED PCB along the circumference of the LED PCB, a capacitor is soldered at the center of the bottom of the LED PCB, and the capacitor is received in a capacitor box, a LED driving circuit is received in the bottom of a cavity of the lamp holder, and a fan is received in an opening end of the cavity of the lamp holder, an annular body of the capacitor box contacts with and fixes the fan; the LED driving circuit, the fan and the LED PCB are connected by a wire; a plurality of axially-arranged air outlet flues are opened in the lamp cover and extend into inner cavity of the lamp cover, a penetrating hole matching the air outlet flue and penetrated by the air outlet flue is opened in the LED PCB; a heat dissipation passageway of the LED lamp consists of: an air inlet arranged in an annular wall extending inwards from an inner wall of a recess ring of the lower lamp body, the air inlet communicating with the air outside of the LED lamp, a window opened in an outer wall of the lamp holder with the outer wall matching the air inlet of the lower lamp body, an air outlet formed between the annular body and a plurality of beams, a penetrating hole and an air flow channel opened in the upper lamp body, and the air outlet flue butting against the penetrating hole of the upper lamp body.

Preferably, the upper lamp body consists of: the prism with an open bottom, an annular protruding step protruding radially and outwards from the bottom of the prism, a protruding edge protruding from an edge of intersection of two neighboring facets and aligned with outer edge of the annular protruding step, a plurality of locating protruding blocks protruding from the annular protruding step between two protruding edges, an annular step recessedly formed between two locating protruding blocks, a screw hole opened in the annular step for receiving a screw, a through-hole opened at the center of the top of the prism for receiving the capacitor box, the penetrating hole opened around the through-hole and aligned with the air outlet flue of the lamp cover, and a screw hole for butting against a screw hole of the LED PCB.

Preferably, the lower lamp body consists of: a cylinder, the recess ring extending radially and outwards from an opening of the cylinder for receiving the lamp cover, the annular wall extending inwards from an inner wall of the recess ring, the air inlet arranged in the annular wall and communicating with the air outside of the LED lamp, a plurality of studs protruding inwards between an inner wall of the recess ring and the annular wall for butting against the screw holes of the upper lamp body, and a fin provided on an outer wall of the cylinder and on an outer wall of the recess ring.

Preferably, a tenon is molded at the top of the LED aluminum substrate so as to be inserted into a corresponding insertion slot of the LED PCB, a recess matching the locating protruding block of the upper lamp body is formed at the bottom of the LED aluminum substrate, a plurality of LED bulbs are arranged on a panel of the LED aluminum substrate; the LED PCB consists of: the capacitor soldered at the center of the bottom of the LED PCB, the penetrating hole matching the air outlet flue and penetrated by the air outlet flue, the insertion slot for inserting the tenon molded at the top of the LED aluminum substrate, a soldering joint for connecting with the wire, the screw hole butting against the screw hole of the upper lamp body, and a LED bulb arranged on a panel of the LED PCB.

Preferably, the capacitor box consists of: a cup body at the top thereof, the capacitor received in the cup body, an axially-arranged wire groove protruding from a side wall of the cup body for receiving the wire, the annular body connected to the bottom of the cup body by the plurality of beams for fixing the fan, and the air outlet formed between the annular body and the plurality of beams.

Preferably, the lamp holder consists of: a tube body, a plurality of windows opened in an outer wall at the top of the tube body, a step molded at the bottom of the tube body, a screw head molded at the bottom of the step and screwedly connected to a lamp cap, a radially-arranged locating protrusion protruding from an outer wall at the bottom of the window of the tube body, an axially-arranged locating protrusion protruding from an outer wall at the top of the step of the tube body, and the LED driving circuit received in the tube body.

Preferably, the lamp cover consists of a upper lamp cover and a lower lamp cover fastened together through a recess/protrusion coupling, the upper lamp cover comprises four air outlet flues uniformly distributed around the center of the upper lamp cover and extending into inner cavity of the lamp cover for communicating with the air outside of the LED lamp.

The present invention also aims to provide a method for manufacturing a LED lamp with a fan comprises the steps of:

(1) putting a LED driving circuit into a lamp holder and fixing a lamp cap to the lamp holder by a screw head of the lamp holder;

(2) mounting a fan on the top of the lamp holder and fixing the fan with a capacitor box, then fixing a wire in a wire groove of the capacitor box;

(3) putting the above installed assembly into a lower lamp body and fixing the assembly by a locating protrusion of the lamp holder;

(4) fixing an upper lamp body onto the lower lamp body by a screw;

(5) connecting a LED aluminum substrate to the upper lamp body by a recess of the LED aluminum substrate and a matching locating protruding block of the upper lamp body;

(6) connecting a LED PCB to the LED aluminum substrate by a insertion slot of the LED PCB 5 and a tenon molded at the top of the LED aluminum substrate, and fixing the LED PCB to the upper lamp body by a screw;

(7) soldering together a junction of the insertion slot of the LED PCB and the tenon molded at the top of the aluminum substrate by tin soldering so as to form an electric circuit between them;

(8) soldering an end of the wire to a soldering joint of the LED PCB;

(9) fixing a lamp cover to a recess ring of the lower lamp body.

Comparing with prior arts, the LED lamp of present invention has the following advantages.

(1) Air flows into the LED lamp from the lamp body and the lamp holder, then passes through an inner air flow channel of the lamp body, in this way, the air outlet flues of the present invention will dissipate heat away from the LED bulb. Therefore, a proper temperature can be maintained in the lamp body, and a high-power LED lamp can thus be manufactured.

(2) The lamp body of the present invention is not exposed to users and is received in the lamp cover, so users will not contact metal of the LED lamp directly and the use of this LED lamp is thus very safe.

(3) The external of the lamp body of the present invention has heat dissipation fins and the interior of the lamp body has an air flow channel, and the air outlet flues of the lamp cover of the present invention can easily dissipate heat away from the LED lamp, therefore the LED lamp of the present invention has a high heat dissipation efficiency.

(4) The capacitor box of the present invention has a wire groove that facilitates assembling a wire.

LIST OF REFERENCE NUMERALS

Figure 1:
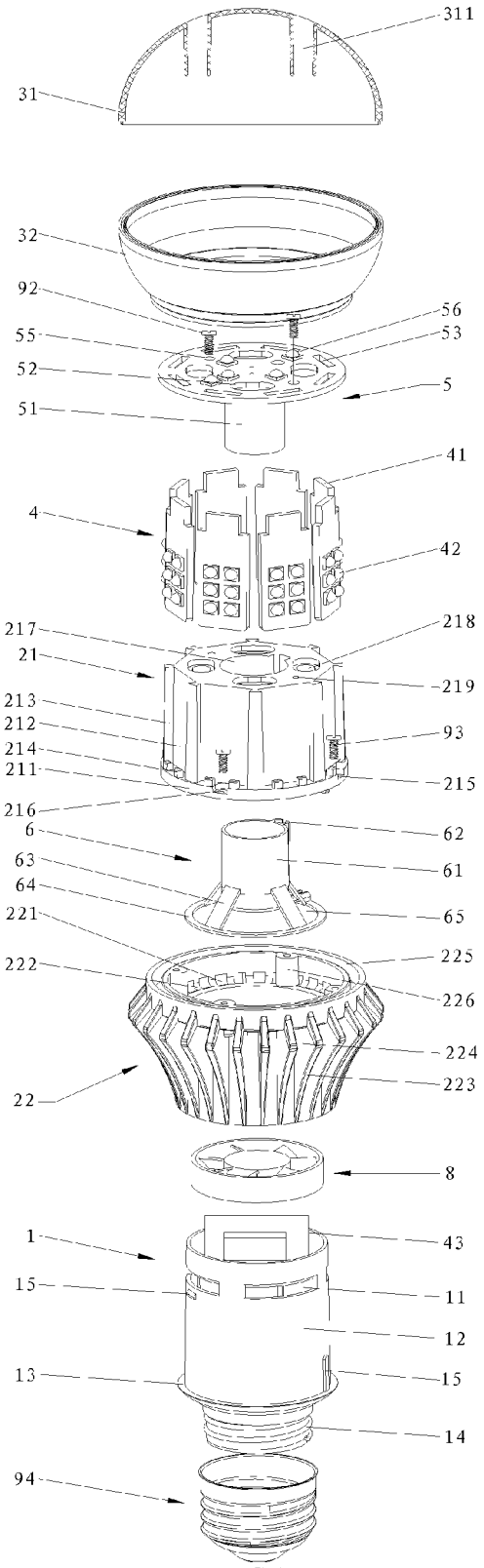
FIG. 1 is an exploded view of a LED lamp with a fan of the present invention.

1 lamp holder
11 window
12 tube body
13 step
14 screw head
15 locating protrusion
2 lamp body
21 upper lamp body
211 annular protruding step
212 facet
213 protruding edge
214 locating protruding block
215 annular step
216 screw hole
217 through-hole
218 penetrating hole
219 screw hole
22 lower lamp body
221 annular wall
222 air inlet
223 fin
224 cylinder
225 recess ring
226 stud
3 lamp cover
31 upper lamp cover
311 air outlet flue
32 lower lamp cover
4 LED aluminum substrate
41 tenon
42 LED bulb
43 LED driving circuit
5 LED PCB
51 capacitor
52 penetrating hole
53 insertion slot
54 soldering joint
55 screw hole
56 LED bulb
6 capacitor box
61 cup body
62 wire groove
63 beam
64 annular body
65 air outlet
66 capacitor
7 air flow channel
8 fan
91 wire
92 screw
93 screw
94 lamp cap

DETAILED DESCRIPTION OF ILLUSTRATED EMBODIMENTS

Further description will now be described below in conjunction with the figures.

Figure 2:
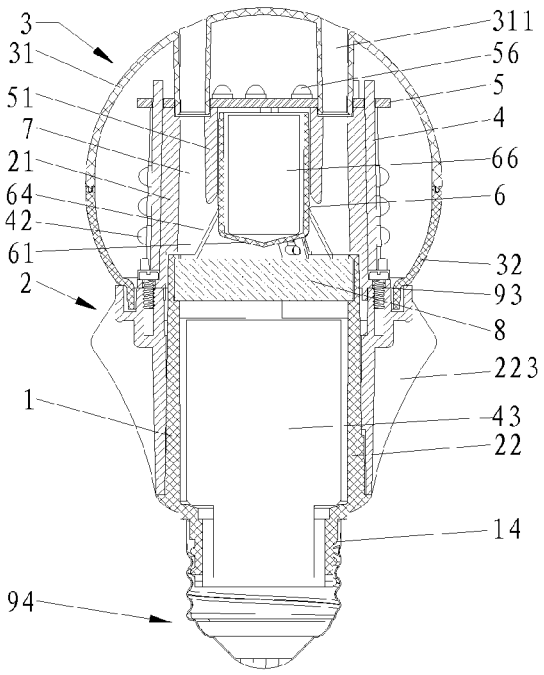
FIG. 2 is a cross-sectional view of an assembled LED lamp with a fan of the present invention viewed at an angle.
Figure 3:
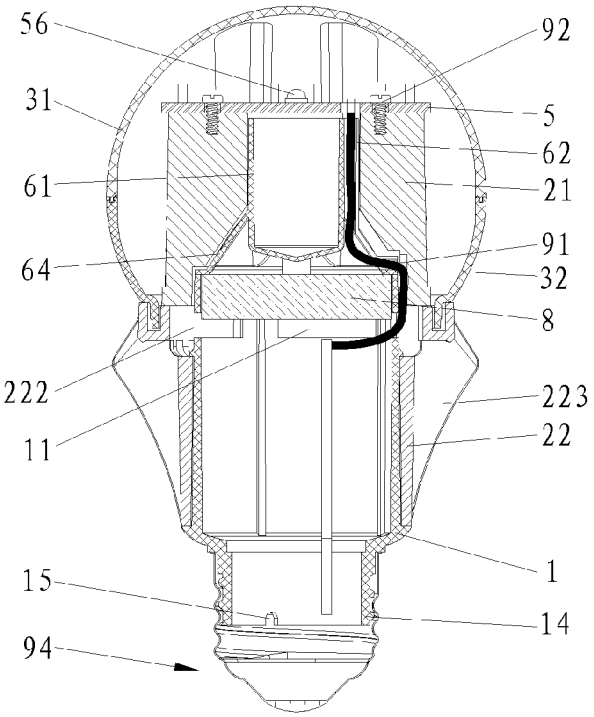
FIG. 3 is a cross-sectional view of an assembled LED lamp with a fan of the present invention viewed at another angle.

As shown in FIGS. 1 to 3, a LED lamp with a fan of the present invention comprises a lamp body 2 sleeving a lamp holder 1, and a lamp cover 3 connected to the lamp body 2.

In an embodiment, the lamp body 2 consists of an upper lamp body 21 and a lower lamp body 22 which are connected by a screw 93; the upper lamp body 21 consists of a prism with an open bottom, an annular protruding step 211 protruding radially and outwards from the bottom of the prism, a protruding edge 213 protruding from an edge of intersection of two neighboring facets 212 and aligned with outer edge of the annular protruding step 211, a plurality of locating protruding blocks 214 protruding from the annular protruding step 211 between two protruding edges 213, an annular step 215 recessedly formed between two locating protruding blocks 214, a screw hole 216 opened in the annular step 215 for receiving the screw 93, a through-hole 217 opened at the center of the top of the prism for receiving a capacitor box 6, a penetrating hole 218 opened around the through-hole 217 and aligned with an air outlet flue 311 of the lamp cover, and a screw hole 219 for butting against a screw hole 55 of a LED PCB 5. An external wall of the facet of the prism of the upper lamp body 21 is covered with a LED aluminum substrate 4, and all the LED aluminum substrates 4 are connected to the LED PCB 5 along the circumference of the LED PCB 5. The lower lamp body 22 consists of a cylinder 224, a recess ring 225 extending radially and outwards from an opening of the cylinder 224 for receiving the lamp cover 3, an annular wall 221 extending inwards from an inner wall of the recess ring 225, an air inlet 222 arranged in the annular wall 221 and communicating with the air outside of the LED lamp, a plurality of studs 226 protruding inwards between an inner wall of the recess ring 225 and the annular wall 221 for butting against the screw holes 216 of the upper lamp body, and a fin 223 provided on an outer wall of the cylinder 224 and on an outer wall of the recess ring 225.

Figure 4:
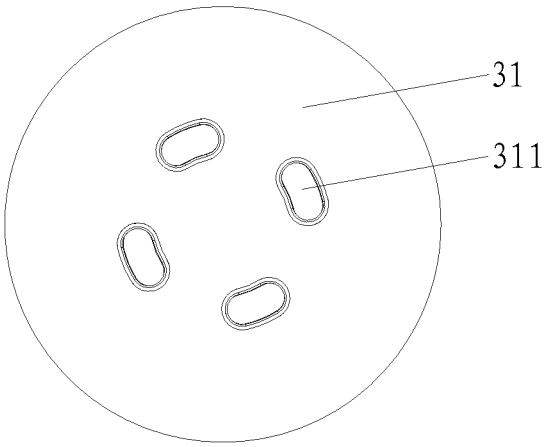
FIG. 4 is a perspective view of a lamp cover of a LED lamp with a fan of the present invention.

As shown in FIG. 4, the lamp cover 3 consists of a upper lamp cover 31 and a lower lamp cover 32 fastened together through a recess/protrusion coupling, wherein the upper lamp cover 31 comprises four air outlet flues 311 uniformly distributed around the center of the upper lamp cover 31 and extending into inner cavity of the lamp cover 31 for communicating with the air outside of the LED lamp.

Figure 5:
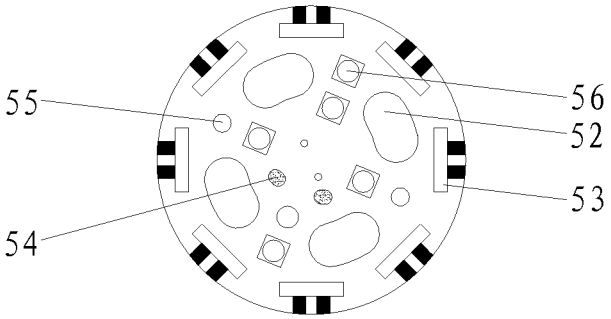
FIG. 5 is a perspective view of a LED PCB of a LED lamp with a fan of the present invention.

As shown in FIG. 5, the LED PCB 5 consists of a capacitor 51 soldered at the center of the bottom of the LED PCB, a penetrating hole 52 matching the air outlet flue 311 and penetrated by the air outlet flue 311, a insertion slot 53 for inserting a tenon 41 molded at the top of the LED aluminum substrate, a soldering joint 54 for connecting with a wire 91, the screw hole 55 butting against the screw hole 219 of the upper lamp body, and a LED bulb 56 arranged on a panel of the LED PCB. The capacitor 51 of the LED PCB is received in a cup body 61 of the capacitor box, a LED driving circuit 43 is received in the bottom of a cavity of the lamp holder 1, and a fan 8 is received in an opening end of the cavity of the lamp holder 1.

In the embodiment, the tenon 41 is molded at the top of the LED aluminum substrate 4 so as to be inserted into the corresponding insertion slot 53 of the LED PCB 5, a recess (figures not shown) matching the locating protruding block 214 of the upper lamp body is formed at the bottom of the LED aluminum substrate 4, and a plurality of LED bulbs 42 are arranged on a panel of the LED aluminum substrate 4.

In the embodiment, the capacitor box 6 consists of the cup body 61 at the top thereof, an axially-arranged wire groove 62 protruding from a side wall of the cup body 61 for receiving the wire 91, an annular body 64 connected to the bottom of the cup body 61 by a plurality of beams 63 for fixing the fan 8, and an air outlet 65 formed between the annular body 64 and the plurality of beams 63. The annular body 64 of the capacitor box 6 contacts with and fixes the fan 8; the LED driving circuit 43, the fan 8 and the LED PCB 5 are connected by the wire 91.

In the embodiment, a heat dissipation passageway of the LED lamp consists of the air inlet 222 arranged in the annular wall 221 extending inwards from an inner wall of the recess ring 225 of the lower lamp body 22, the air inlet 222 communicating with the air outside of the LED lamp, a window 11 opened in an outer wall of the lamp holder 1 with the outer wall matching the air inlet 222 of the lower lamp body, the air outlet 65 formed between the annular body 64 of the capacitor box and the plurality of beams 63, the penetrating hole 218 and an air flow channel 7 opened in the upper lamp body 21, and the air outlet flue 311 butting against the penetrating hole 218.

In the embodiment, the lamp holder 1 consists of a tube body 12, a plurality of windows 11 opened in an outer wall at the top of the tube body 12, a step 13 molded at the bottom of the tube body 12, a screw head 14 molded at the bottom of the step 13 and screwedly connected to a lamp cap 94, a radially-arranged locating protrusion 15 protruding from an outer wall at the bottom of the window 11 of the tube body 12, an axially-arranged locating protrusion 15 protruding from an outer wall at the top of the step 13 of the tube body 12, and the LED driving circuit 43 received in the tube body 12.

The working principles of the LED lamp of present invention are as following: the LED bulb 42 gives out light and the fan whirls after the LED driving circuit 43 has been connected with a power supply, air flows into the LED lamp from the air inlet 222 of the lower lamp body 22 and the window 11 of the lamp holder 1, the air then passes through the penetrating hole 218 of the upper lamp body 21, in this way, the air outlet flues 311 will dissipate heat away from the LED lamp.

A method for manufacturing a LED lamp with a fan comprises the steps of:

(1) putting a LED driving circuit 43 into a lamp holder 1 and fixing a lamp cap 94 to the lamp holder 1 by a screw head 14 of the lamp holder;

(2) mounting a fan 8 on the top of the lamp holder 1 and fixing the fan 8 with a capacitor box 6, then fixing a wire 91 in a wire groove 62 of the capacitor box;

(3) putting the above installed assembly into a lower lamp body 22 and fixing the assembly by a locating protrusion 15 of the lamp holder 1;

(4) fixing an upper lamp body 21 onto the lower lamp body 22 by a screw 93;

(5) connecting a LED aluminum substrate 4 to the upper lamp body by a recess (figures not shown) of the LED aluminum substrate and a matching locating protruding block 214 of the upper lamp body;

(6) connecting a LED PCB 5 to the LED aluminum substrate 4 by a insertion slot 53 of the LED PCB 5 and a tenon 41 molded at the top of the LED aluminum substrate 4, and fixing the LED PCB 5 to the upper lamp body 21 by a screw 92;

(7) soldering together a junction of the insertion slot 53 of the LED PCB 5 and the tenon 41 molded at the top of the aluminum substrate 4 by tin soldering so as to form an electric circuit between them;

(8) soldering an end of the wire 91 to a soldering joint 54 of the LED PCB 5;

(9) fixing a lamp cover 3 to a recess ring 225 of the lower lamp body 22.

All the above are the preferred embodiments of the present invention, and the invention is intended to cover various modifications and equivalent arrangements included within the scope of the invention.

What is claimed is:

1. A LED lamp with a fan, comprising a lamp body sleeving a lamp holder, and a lamp cover connected to the lamp body, characterized in that, the lamp body consists of an upper lamp body and a lower lamp body connected by a fixing element;

the upper lamp body is a prism, an external wall of a facet of the prism is covered with a LED aluminum substrate, and all the LED aluminum substrates are connected to a LED PCB along the circumference of the LED PCB, a capacitor is soldered at the center of the bottom of the LED PCB, and the capacitor is received in a capacitor box, a LED driving circuit is received in the bottom of a cavity of the lamp holder, and a fan is received in an opening end of the cavity of the lamp holder, an annular body of the capacitor box contacts with and fixes the fan;

the LED driving circuit, the fan and the LED PCB are connected by a wire;

a plurality of axially-arranged air outlet flues are opened in the lamp cover and extend into inner cavity of the lamp cover, a penetrating hole matching the air outlet flue and penetrated by the air outlet flue is opened in the LED PCB;

a heat dissipation passageway of the LED lamp consists of:

an air inlet arranged in an annular wall extending inwards from an inner wall of a recess ring of the lower lamp body, the air inlet communicating with the air outside of the LED lamp, a window opened in an outer wall of the lamp holder with the outer wall matching the air inlet of the lower lamp body, an air outlet formed between the annular body and a plurality of beams, a penetrating hole and an air flow channel opened in the upper lamp body, and the air outlet flue butting against the penetrating hole of the upper lamp body;

wherein the upper lamp body consists of: the prism with an open bottom, an annular protruding step protruding radially and outwards from the bottom of the prism, a protruding edge protruding from an edge of intersection of two neighboring facets and aligned with outer edge of the annular protruding step, a plurality of locating protruding blocks protruding from the annular protruding step between two protruding edges, an annular step recessedly formed between two locating protruding blocks, a screw hole opened in the annular step for receiving a screw, a through-hole opened at the center of the top of the prism for receiving the capacitor box, the penetrating hole opened around the through-hole and aligned with the air outlet flue of the lamp cover, and a screw hole for butting against a screw hole of the LED PCB;

wherein the lower lamp body consists of: a cylinder, the recess ring extending radially and outwards from an opening of the cylinder for receiving the lamp cover, the annular wall extending inwards from an inner wall of the recess ring, the air inlet arranged in the annular wall and communicating with the air outside of the LED lamp, a plurality of studs protruding inwards between an inner wall of the recess ring and the annular wall for butting against the screw holes of the upper lamp body, and a fin provided on an outer wall of the cylinder and on an outer wall of the recess ring;

a tenon is molded at the top of the LED aluminum substrate so as to be inserted into a corresponding insertion slot of the LED PCB;

a recess matching the locating protruding block of the upper lamp body is formed at the bottom of the LED aluminum substrate;

a plurality of LED bulbs are arranged on a panel of the LED aluminum substrate;

wherein the LED PCB consists of: the capacitor soldered at the center of the bottom of the LED PCB, the penetrating hole matching the air outlet flue and penetrated by the air outlet flue, the insertion slot for inserting the tenon molded at the top of the LED aluminum substrate, a soldering joint for connecting with the wire, the screw hole butting against the screw hole of the upper lamp body, and a LED bulb arranged on a panel of the LED PCB;

wherein the capacitor box consists of: a cup body at the top thereof, the capacitor received in the cup body, an axially-arranged wire groove protruding from a side wall of the cup body for receiving the wire, the annular body connected to the bottom of the cup body by the plurality of beams for fixing the fan, and the air outlet formed between the annular body and the plurality of beams.

2. The LED lamp with a fan according to claim 1, characterized in that, the lamp holder consists of:

a tube body, a plurality of windows opened in an outer wall at the top of the tube body, a step molded at the bottom of the tube body, a screw head molded at the bottom of the step and screwedly connected to a lamp cap, a radially-arranged locating protrusion protruding from an outer wall at the bottom of the window of the tube body, an axially-arranged locating protrusion protruding from an outer wall at the top of the step of the tube body, and the LED driving circuit received in the tube body.

3. The LED lamp with a fan according to claim 1, characterized in that, the lamp cover consists of a upper lamp cover and a lower lamp cover fastened together through a recess/protrusion coupling, the upper lamp cover comprises four air outlet flues uniformly distributed around the center of the upper lamp cover and extending into inner cavity of the lamp cover for communicating with the air outside of the LED lamp.

4. A method for manufacturing a LED lamp with a fan according to claim 1 comprising the steps of:

(1) putting a LED driving circuit into a lamp holder and fixing a lamp cap to the lamp holder by a screw head of the lamp holder;

(2) mounting a fan on the top of the lamp holder and fixing the fan with a capacitor box, then fixing a wire in a wire groove of the capacitor box;

(3) putting the above installed assembly into a lower lamp body and fixing the assembly by a locating protrusion of the lamp holder;

(4) fixing an upper lamp body onto the lower lamp body by a screw;

(5) connecting a LED aluminum substrate to the upper lamp body by a recess of the LED aluminum substrate and a matching locating protruding block of the upper lamp body;

(6) connecting a LED PCB to the LED aluminum substrate by a insertion slot of the LED PCB 5 and a tenon molded at the top of the LED aluminum substrate, and fixing the LED PCB to the upper lamp body by a screw;

(7) soldering together a junction of the insertion slot of the LED PCB and the tenon molded at the top of the aluminum substrate by tin soldering so as to form an electric circuit between them;

(8) soldering an end of the wire to a soldering joint of the LED PCB;

(9) fixing a lamp cover to a recess ring of the lower lamp body.

* * * * *